US011946332B2

(12) United States Patent
Fripp et al.

(10) Patent No.: US 11,946,332 B2
(45) Date of Patent: Apr. 2, 2024

(54) METALLIC DELAY BARRIER COATING FOR SWELLABLE PACKERS

(71) Applicant: HALLIBURTON ENERGY SERVICES, INC., Houston, TX (US)

(72) Inventors: Michael Linley Fripp, Carrollton, TX (US); Xiaoguang Allan Zhong, Plano, TX (US); Benjamin Jon Wellhoefer, Montgomery, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 785 days.

(21) Appl. No.: 17/051,489

(22) PCT Filed: Dec. 17, 2019

(86) PCT No.: PCT/US2019/066942

§ 371 (c)(1),
(2) Date: Oct. 29, 2020

(87) PCT Pub. No.: WO2021/126173

PCT Pub. Date: Jun. 24, 2021

(65) Prior Publication Data

US 2023/0160276 A1 May 25, 2023

(51) Int. Cl.
*E21B 33/12* (2006.01)
*C22C 23/02* (2006.01)
(Continued)

(52) U.S. Cl.
CPC ..... *E21B 33/1208* (2013.01); *C22C 23/02* (2013.01); *C22C 23/04* (2013.01); *C22C 23/06* (2013.01); *E21B 2200/08* (2020.05)

(58) Field of Classification Search
CPC .... E21B 33/1208; E21B 2200/08; C09K 8/14
(Continued)

(56) References Cited

U.S. PATENT DOCUMENTS 3,918,523 A * 11/1975 Stuber ..... E21B 33/14 166/292
7,562,704 B2 7/2009 Wood et al.
(Continued)

FOREIGN PATENT DOCUMENTS

GB 2595797 A 12/2021
WO 2008079486 A1 7/2008
WO 2016081287 A1 5/2016

OTHER PUBLICATIONS

International Search Report and Written Opinion for PCT/US2019/066942 dated Sep. 15, 2020.
(Continued)

*Primary Examiner* — Zakiya W Bates
*Assistant Examiner* — Ashish K Varma
(74) *Attorney, Agent, or Firm* — NOVAK DRUCE CARROLL LLP

(57) ABSTRACT

A swellable packer assembly that includes a mandrel, a sealing element disposed about a least a portion of the mandrel, and a degradable metal coating disposed about at least a portion of an outer surface of the sealing element. The degradable metal coating fluidly isolates the portion of an outer surface of the sealing element from an exterior of the coating and the sealing element is formed of a material responsive to exposure to a fluid in a wellbore to radially expand from the mandrel. The degradable metal coating is selectively removable from the mandrel downhole so as to expose the sealing element to the fluid in the wellbore.

18 Claims, 4 Drawing Sheets

(51) Int. Cl.
*C22C 23/04* (2006.01)
*C22C 23/06* (2006.01)

(58) Field of Classification Search
USPC ..... 166/292
See application file for complete search history.

(56) References Cited

U.S. PATENT DOCUMENTS

| | | | | |
|---|---|---|---|---|
| 7,681,653 | B2 | 3/2010 | Korte et al. | |
| 8,408,319 | B2 | 4/2013 | Chen et al. | |
| 2009/0205841 | A1 | 8/2009 | Kluge et al. | |
| 2013/0092394 | A1 | 4/2013 | Holderman et al. | |
| 2014/0102728 | A1 | 4/2014 | Gamstedt et al. | |
| 2016/0127912 | A1 | 5/2016 | Markwart et al. | |
| 2016/0137912 | A1 | 5/2016 | Sherman et al. | |
| 2016/0230494 | A1* | 8/2016 | Fripp | E21B 33/12 |
| 2019/0092998 | A1* | 3/2019 | Kovalchuk | C04B 18/24 |
| 2020/0362224 | A1* | 11/2020 | Wellhoefer | C09K 8/5083 |
| 2022/0034188 | A1* | 2/2022 | Scott, Jr. | E21B 33/1208 |

OTHER PUBLICATIONS

Search Opinion; Denmark Application No. PA 2022 70258; dated May 8, 2023.
International Search Report and Written Opinion for PCT/US2019/066942 dated Sep. 15, 2020, pages.
Examination Report; Great Britain Application No. 2205059.5; dated Aug. 14, 2023.

* cited by examiner

METALLIC DELAY BARRIER COATING FOR SWELLABLE PACKERS

CROSS-REFERENCE TO RELATED APPLICATIONS

This application is a national stage entry of PCT/US2019/066942 filed Dec. 17, 2019, said application is expressly incorporated herein by reference in its entirety.

FIELD

The present disclosure relates to downhole tools used in subterranean wellbores. In particular, the present disclosure relates to swellable packers used in oil and gas operations.

BACKGROUND

Wellbores are drilled into the earth for a variety of purposes including tapping into hydrocarbon bearing formations to extract the hydrocarbons for use as fuel, lubricants, chemical production, and other purposes. During wellbore operations related to exploration, drilling, and production of hydrocarbons from subterranean geologic formations, it is often desirable to isolate two or more portions of a wellbore, such as during the performance of a stimulation operation (e.g., a perforation and/or hydraulic fracturing operation), during completion (e.g., cementing operations), and during production of hydrocarbons from subterranean formations. Accordingly, packers or similar isolation tools may be used to provide a fluid seal between portions of a wellbore or between tubular components in a wellbore. The packer may be radially expanded into contact with a wellbore wall or the inner surface of an outer tubular structure to create a seal in an annulus defined between the tubing string and the outer tubular structure or wellbore wall. In some instances, packers may also be used to secure a casing string within a wellbore.

During operation, mechanical or hydraulic systems may be employed to expand the packer. In other systems, the packer may be induced to expand by exposing the swellable element in the packer to a predetermined trigger fluid in the wellbore. Swellable packers may include an elastomeric element that is selected to expand in response to exposure to a particular trigger fluid. The trigger fluid may be a fluid present in the wellbore, e.g., a hydrocarbon based fluid, or a fluid pumped into the wellbore from the surface. This type of passive actuation may make swellable packers attractive for use in downhole applications where space may be too limited for mechanical or hydraulic systems.

In some instances, a swellable packer may begin to expand prior to reaching the intended location in the wellbore. For example, a swellable packer being run into a wellbore on a conveyance, e.g., tubing string, coiled tubing, a wireline or slickline, may reach the intended depth after a time period of about two days, and the swellable packer may be exposed to the trigger fluid throughout this time period. If there are unexpected delays in placing the packer, the swellable packer may make contact with an outer tubular structure or wellbore wall at an unintended location. Continued swelling of the packer may cause the packer and/or the conveyance to become stuck in the wellbore. Accordingly, methods and apparatus capable of delaying or otherwise controlling the swelling and/or swell-rate of swellable packers are desirable.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
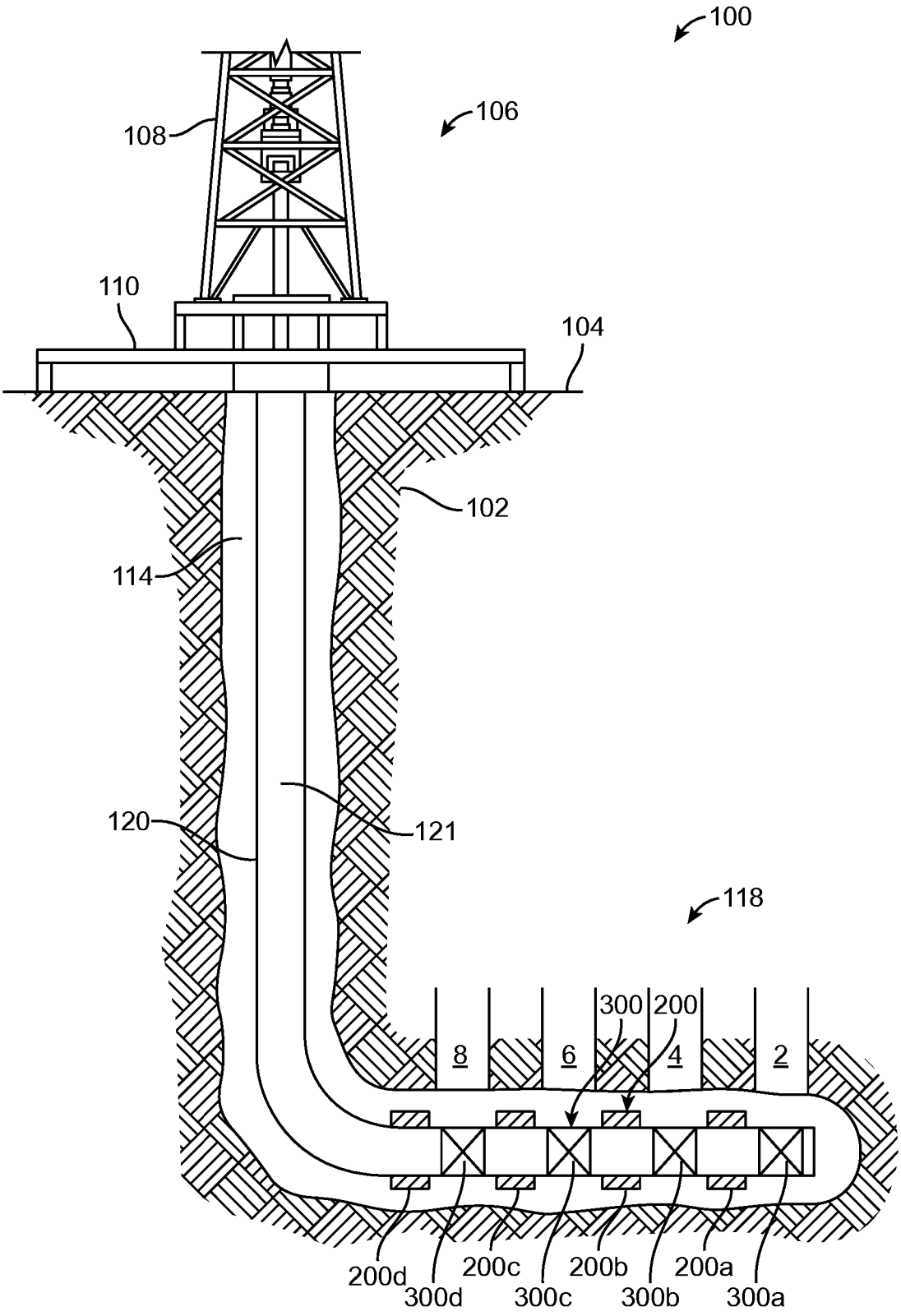
FIG. 1 is a schematic view of a wellbore operating environment in which a swellable packer may be deployed in accordance with certain exemplary embodiments of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

In the following discussion and in the claims, the terms "including" and "comprising" are used in an open-ended fashion, and thus should be interpreted to mean "including, but not limited to . . . ". Reference to up or down will be made for purposes of description with "upper," or "uphole" meaning toward the surface of the wellbore and with "lower," or "downhole" meaning toward the terminal end of the well, regardless of the wellbore orientation.

As used herein, the term "swellable material" refers to any material that swells (e.g., exhibits an increase in mass and volume) upon contact with a selected fluid. A swellable material may in some instances include a polymer, such as an elastomer. The selected fluid may be, for example, a swelling agent. It is to be understood that the terms "polymer" and "polymeric material" are meant to be used interchangeably and refer to compositions comprising at least one polymerized monomer in the presence or absence of other additives traditionally included in such materials.

As used herein, the term "derivative" refers to any compound that is made from one or more of the swellable materials, for example, by replacing one atom in the swellable material with another atom or group of atoms, rearranging two or more atoms in the swellable material, ionizing one of the swellable materials, or creating a salt of one of the swellable materials. The term "copolymer," as used herein, is not limited to the combination of two polymers, but refers to any combination of any number of polymers, e.g., graft polymers, terpolymers, and the like.

The various characteristics described in more detail below, will be readily apparent to those skilled in the art with the aid of this disclosure upon reading the following detailed description, and by referring to the accompanying drawings.

The present disclosure is directed to swellable packer assemblies for positioning the wellbore. According to an aspect of the present disclosure, the swellable packer assembly may include a mandrel and a sealing element disposed about a least a portion of the mandrel. The sealing element may be formed of a material responsive to exposure to a fluid in a wellbore to radially expand from the mandrel. The swellable packer assembly may further include a degradable metal coating disposed about at least a portion of an outer surface of the sealing element. The degradable metal coating is capable of fluidly isolating the portion of an outer surface of the sealing element from an exterior of the coating. The degradable metal coating may be selectively removable from the mandrel downhole so as to expose the sealing element to the fluid in the wellbore.

In some instances, the degradable metal coating may be selectively removable from the mandrel upon downhole application of a voltage to the coating. In other instances, the degradable metal coating is selectively removable from the mandrel upon exposure to a downhole fluid. The degradable metal coating may be configured to degrade upon contact with a downhole fluid so as to expose the sealing element to the fluid in the wellbore. In some cases, the coating may be configured to degrade in a downhole environment of a wellbore after a predetermined amount of time so as to expose the sealing element to the fluid in the wellbore. In some instances, the degradable metal coating galvanically corrodes upon exposure to a wellbore fluid.

The degradable metal coating may comprise a metal or metal alloy dissolvable upon exposure to a wellbore fluid. In some instances, the degradable metal coating may be a metal alloy comprising at least one selected from the group consisting of magnesium, aluminum, and calcium. According to an aspect of the present disclosure, the degradable metal coating may comprise a doped magnesium alloy or a doped aluminum alloy.

According to another aspect of the present disclosure, a method of using a swellable packer assembly is provided. The method may include running a swellable packer assembly into a wellbore on a conveyance so as to position the swellable packer assembly at a predetermined downhole location. The sealing element of the swellable packer assembly is in an inactivated configuration when it is run into the wellbore. The method may further include selectively removing a degradable metal coating disposed about at least a portion of an outer surface of the sealing element. The method may also include causing the sealing element to be exposed to a wellbore fluid thereby activating the sealing element to induce swelling of the sealing element.

The selectively removing a degradable metal coating may include causing the degradable metal coating to be exposed to a wellbore fluid, or alternatively, exposing the degradable metal coating to a trigger fluid circulated from the surface or released by a downhole tool. In other cases, the selectively removing a degradable metal coating may include applying a voltage to the degradable metal coating. In some instances, the degradable metal coating may be selectively removed after a predetermined period of time.

According to another aspect of the present disclosure, a downhole swellable packer system is provided. The system may include a conveyance and a mandrel coupled with the conveyance. The system may further include a sealing element disposed about a least a portion of the mandrel. The sealing element may be formed of a material responsive to exposure to a trigger fluid in a wellbore to radially expand from the mandrel. The system may also include a degradable metal coating disposed about at least a portion of an outer surface of the sealing element. The degradable metal coating may fluidly isolate the portion of an outer surface of the sealing element from an exterior of the coating. The degradable metal coating may be selectively removable from the mandrel downhole so as to expose the sealing element to the trigger fluid in the wellbore. In at least some instances, the trigger fluid may be an organic acid. In some cases, the trigger fluid may be an organic acid selected from the group consisting of citric acid, formic acid, lactic acid, and any combination thereof.

According to one aspect of the present disclosure, the system may further include a triggering fluid disposed within the wellbore that is configured to cause the degradable metal coating to degrade.

According to an aspect of the present disclosure a method of making a swellable packer assembly is provided. The method may include providing a sealing element disposed about a least a portion of a mandrel. The sealing element may include a material responsive to exposure to a fluid in a wellbore to radially expand from the mandrel. The method may also include depositing a degradable metal coating on at least a portion of an outer surface of a sealing element.

FIG. 1 illustrates a schematic view of an embodiment of a wellbore operating environment in which a swellable packer assembly may be deployed. As depicted in FIG. 1, the operating environment 100 includes a wellbore 114 that penetrates a subterranean formation 102 that includes a plurality of formation zones 2, 4, 6, and 8 for the purpose of recovering hydrocarbons, storing hydrocarbons, disposing of carbon dioxide, or the like. The wellbore 114 may extend substantially vertically away from the Earth's surface over a vertical wellbore portion, or may deviate at any angle from the Earth's surface 104 over a deviated or horizontal wellbore portion 118. In alternative operating environments, portions or substantially all of the wellbore 114 may be vertical, deviated, horizontal, and/or curved. The wellbore 114 may be drilled into the subterranean formation 102 using any suitable drilling technique. In an embodiment, a drilling or servicing rig 106 disposed at the surface 104 comprises a derrick 108 with a rig floor 110 through which a tubular string (e.g., a drill string, a tool string, a segmented tubing string, a jointed tubing string, or any other suitable conveyance, or combinations thereof) generally defining an axial flowbore may be positioned within or partially within the wellbore 114. In an embodiment, the tubular strings may include two or more concentrically positioned strings of pipe or tubing (e.g., a first work string may be positioned within a second work string). The drilling or servicing rig 106 may be conventional and may include a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. In such an environment, the tubular string may be utilized in drilling, stimulating, completing, or otherwise servicing the wellbore, or combinations thereof.

While FIG. 1 depicts a stationary drilling rig 106, one of ordinary skill in the art will readily appreciate that mobile workover rigs, wellbore servicing units (such as coiled tubing units), and the like may be employed. It is noted that while the FIGs. or portions thereof may exemplify horizontal or vertical wellbores, the principles of the presently disclosed apparatuses, methods, and systems, may be similarly applicable to horizontal wellbore configurations, conventional vertical wellbore configurations, deviated wellbore configurations, and any combinations thereof. Therefore, the horizontal, deviated, or vertical nature of any figure is not to be construed as limiting the wellbore to any particular configuration.

As depicted in FIG. 1, at least a portion of the wellbore 114 is lined with a wellbore tubular 120 such as a casing string and/or liner defining an axial flowbore 121. In at least some instances, one or more swellable packer assemblies 200, such as a first swellable packer assembly 200*a*, second swellable packer assembly 200*b*, third swellable packer assembly 200*c*, and fourth swellable packer assembly 200*d*, may be disposed within the wellbore 114. In some instances, the one or more swellable packer assemblies 200 may be used to isolate two or more adjacent portions or zones within subterranean formation 102 and/or wellbore 114. In some cases, the swellable packer assemblies 120 are operable to engage and/or seal against an outer tubular string such as tubular string 120. According to at least one aspect of the present disclosure, at least a portion of the wellbore tubular 120 is secured into position against the formation 102 via a plurality of swellable packer assemblies 200, such as assemblies 200*a*-200*d*. In at least some instances, a portion of the wellbore tubular 120 may be partially secured into position against the formation 102 in a conventional manner with cement.

As depicted in FIG. 1, the operating environment 100 may further include at least one downhole tool 300 (e.g., a first downhole tool 300*a*, a second downhole tool 300*b*, a third downhole tool 300*c*, and a fourth downhole tool 300*d*). In some instances, one or more downhole tools 300 may include an actuatable stimulation assembly, which may be configured for the performance of a wellbore servicing operation, such as, a stimulation operation. Various stimulation operations can include, but are not limited to a perforating operation, a fracturing operation, an acidizing operation, or any combination thereof.

Figure 2:
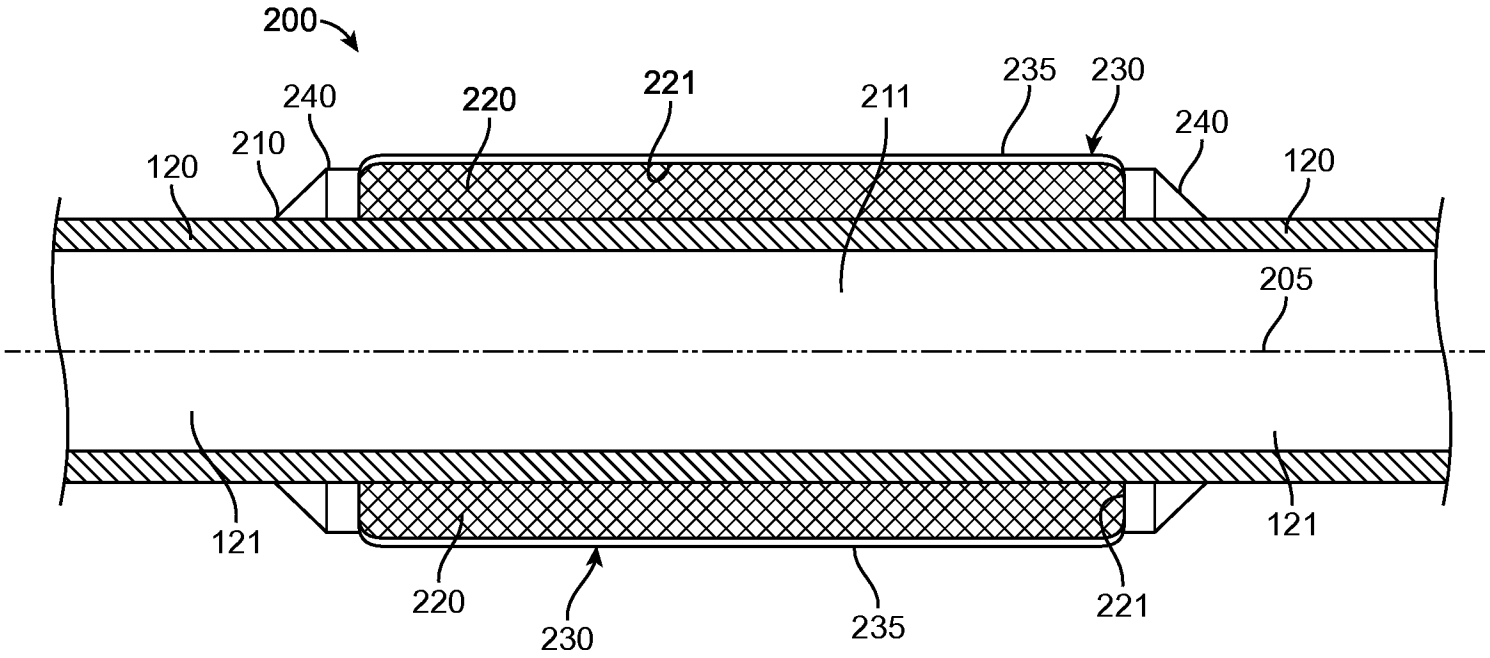
FIG. 2 is a cross-sectional view of a swellable packer assembly according to certain exemplary embodiments of the present disclosure.

FIG. 2 depicts a cross-sectional view of a swellable packer assembly according to certain exemplary embodiments of the present disclosure. As depicted in FIG. 2, a swellable packer assembly 200 according to an aspect of the present disclosure is presented. Swellable packer assembly 200 may include a mandrel 210, a sealing element 220 disposed circumferentially about/around at least a portion of the mandrel 210, and a coating 230 covering at least a portion of the sealing element 230. As depicted in FIG. 2, swellable packer assembly 200 may be characterized with respect to a central or longitudinal axis 205.

The sealing element 220 may generally be configured to seal and/or isolate two or more portions of an annular space surrounding the swellable packer assembly 200 (e.g., between the swellable packer assembly 200 and one or more walls of the wellbore 114 or wellbore tubular 120), for example, by providing a barrier extending circumferentially around at least a portion of the exterior of the swellable packer assembly 200. In some instances, the sealing element 220 may comprise a hollow cylindrical structure having an interior bore (e.g., a tube-like and/or a ring-like structure). In at least some instances, the sealing element 220 may be in sealing contact with (e.g., a fluid-tight seal) with the mandrel 210. The sealing element 220 may comprise a suitable internal diameter, a suitable external diameter, and/or a suitable thickness, for example, as may be selected by one of skill in the art upon viewing this disclosure and in consideration of factors including, but not limited to, the size/diameter of the mandrel 210, the wall against which the sealing element is configured to engage, the force with which the sealing element is configured to engage such surface(s), or other related factors. For example, the internal diameter of the sealing element 220 may be about the same as an external diameter of the mandrel 210.

While FIG. 2 depicts a swellable packer assembly comprising a single sealing element 220, one of skill in the art, upon viewing this disclosure, will appreciate that a similar swellable packer assembly may comprise, two, three, four, five, or any other suitable number of sealing elements like sealing element 220. According to at least one aspect of the present disclosure, the sealing element 220 comprises a swellable material. Examples of polymeric materials suitable for use as part of the swellable material include, but are not limited to, homopolymers, random, block, graft, star- and hyper-branched polyesters, copolymers, thereof, derivatives thereof, or combinations thereof. According to at least one aspect of the present disclosure, the swellable material may be characterized as a resilient, volume changing material. In some instances, the sealing element 220 may be configured to exhibit a radial expansion (e.g., an increase in exterior diameter) upon being contacted with a swelling agent. The swelling agent may be a water-based fluid (e.g., aqueous solutions, water, etc.), an oil-based fluid (e.g., hydrocarbon fluid, oil fluid, oleaginous fluid, terpene fluid, diesel, gasoline, xylene, octane, hexane, etc.), or combinations thereof. In some instances, the swellable material may comprise a water-swellable material, an oil-swellable material, a water-and-oil-swellable material, or combinations thereof.

As depicted in FIG. 2, the coating 230 covers at least a portion of an outer surface 221 of the sealing element 220. Coating 230 may fluidly isolate at least a portion of an outer surface of the sealing element 220 from a fluid external to an exterior surface 235 of the coating. Therefore, coating 230 is operable to delay the onset of swelling of the sealing element 220 by blocking fluids from contacting the sealing element 220 and causing it to swell, resulting in expansion of the swellable packer assembly 200 to engage the walls of the wellbore or tubular. Coating 230 may be a degradable metal coating that delays the onset of swelling of the sealing element 220 for a predetermined amount of time. Upon exposure to wellbore fluids or to a triggering fluid that may be injected downhole, the degradable metal coating 230 degrades and eventually dissolves. After the degradable metal degrades or dissolves, fluids cause the sealing element 220 to swell thereby causing the swellable packer assembly 200 to expand and engage the walls of the wellbore or wellbore tubular, such as the walls of wellbore 114 or wellbore tubular 120 depicted in FIG. 1.

According to at least one aspect of the present disclosure, the degradable metal coating 230 may degrade or dissolve by galvanically corroding upon exposure to wellbore fluids or a triggering fluid. In other cases, the degradable metal coating 230 may degrade or dissolve upon application of a voltage to the degradable metal coating 230. In such cases, the application of a voltage to the degradable metal coating 230 accelerates electrochemical corrosion and degradation of the degradable metal coating 230. In some cases, the voltage can be generated using a turbine or a battery. In some instances, the voltage can be conveyed downhole via an electrical conductor.

The degradable metal coating 230 may be disposed about the at least a portion of an outer surface of the sealing element 220. In at least some instances the degradable metal coating 230 may be deposited directly on at least a portion of an outer surface 221 of the sealing element 220 by spray deposition, electronic deposition, or other means of deposition. In at least some cases, the degradable metal coating 230 is chemically bonded to at least a portion of an outer surface 221 of the sealing element 220. In other cases, the degradable metal coating 230 is physically adhered to at least a portion of an outer surface 221 of the sealing element 220 by, for example, an adhesive or by electrostatic forces. In some instances, the degradable metal coating 230 may comprise the form of a wrap that is wrapped around at least a portion of the outer surface 221 of the sealing element 220. In such cases, the degradable metal coating 230 may comprise a plurality of layers surrounding at least a portion of the outer surface 221 of the sealing element 220. The wrap may be secured by an adhesive, by electrostatic forces, or by may simply be wrapped around at least a portion of the outer surface 221 of the sealing element 220 by pressure in the absence of an adhesive or other forces adhering the wrap to the outer surface 221 of the sealing element 220. In at least some instances, the wrap may be secured to at least an outer surface 221 of the sealing element 220 by a shrink wrap method, including for example, a heat shrink wrap method. In at least some instances, the degradable metal coating 230 may comprise a metal tape. In such cases, a plurality of layers of metal tape may be applied to at least a portion of the outer surface 221 of the sealing element 220.

According to at least one aspect of the present disclosure, the degradable metal coating 230 is integral to the swellable packer assembly 200 by being directly deposited on at least an outer surface 221 of the sealing element 220. In some instances, the degradable metal coating 230 is directly deposited on at least an outer surface 221 of the sealing element 220 by chemical or electrostatic bonding or interactions. In other instances, the degradable metal coating 230 is directly deposited on at least an outer surface 221 of the sealing element 220 by physical adhesion or pressure wrapping. In at least some instances, the degradable metal coating 230, once deposited, is integral to the swellable packer assembly 200 such that it cannot be easily removed except by degradation. In at least some instances, the degradable metal coating 230, once deposited, is integral to the swellable packer assembly 200 such that it cannot be replaceably removed.

Figure 3:
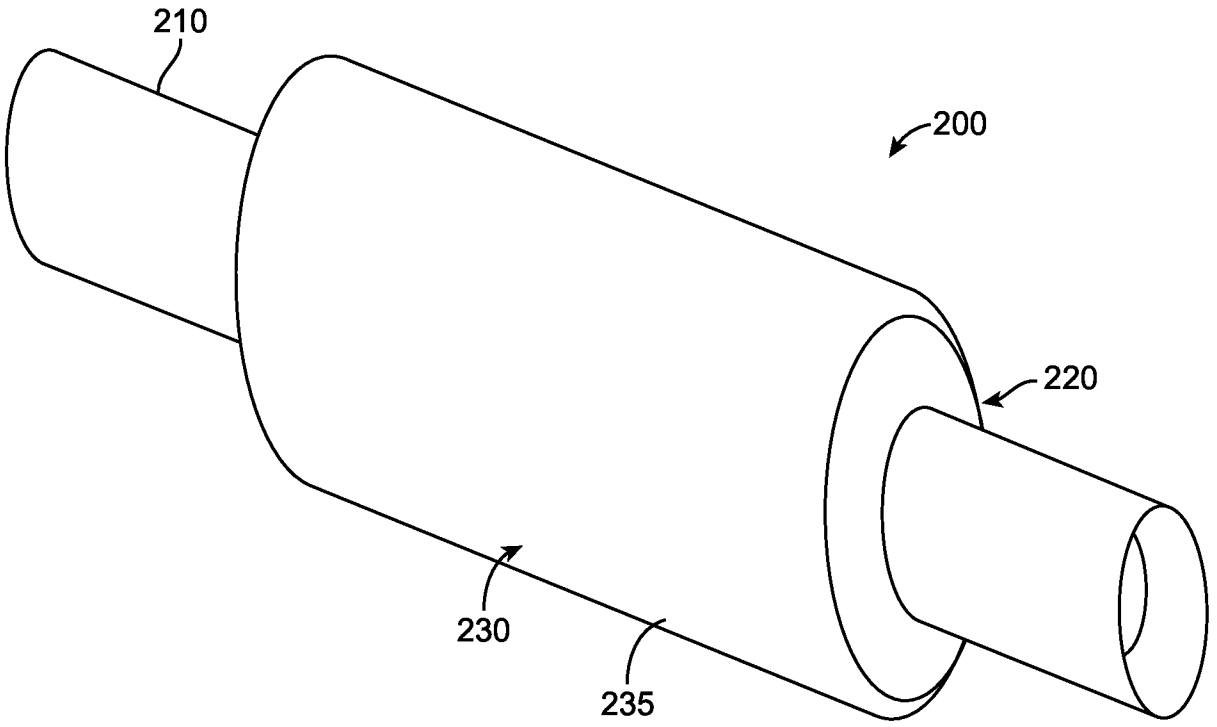
FIG. 3 is an isometric view of a swellable packer assembly according to certain exemplary embodiments of the present disclosure.

FIG. 3 depicts an isometric view of the swellable packer assembly 200 according to certain exemplary embodiments of the present disclosure. As depicted in FIG. 3, sealing element 220 is disposed about at least a portion of the mandrel 210 while degradable metal coating 230 is disposed about at least a portion of an outer surface of the sealing element 220. Coating 230 is capable of fluidly isolating at least a portion of an outer surface of the sealing element 220 from a fluid external to an exterior surface 235 of the coating, thereby delaying the onset of swelling of the sealing element 220 by blocking fluids from contacting the sealing element 220 which would otherwise cause the sealing element 220 to swell and the swellable packer assembly 200 to expand and engage the walls of the wellbore or tubular.

In at least some instances, the degradable metal coating 230 comprises a thin film metal material. In at least some instances, the degradable metal coating may exhibit a thickness of from about 20 thousandths of an inch to about a quarter of an inch. In at least some instances, the degradable metal coating 230 may comprise a mesh or screen structure. In such instances, the mesh or screen structure of the degradable metal coating 230 may provide additional surface area or reaction sites for chemical or galvanic corrosion of the degradable metal coating 230. In at least some instances, the degradable metal coating 230 may be porous. In such instances, the porosity of the degradable metal coating 230 may provide additional surface area or reaction sites for chemical or galvanic corrosion of the degradable metal coating 230. In at least some instances, the porosity of the degradable metal coating 230 may vary along the length of the degradable metal coating 230.

According to at least one aspect of the present disclosure, the degradable metal coating 230 comprises a tensile strength sufficient to contain the sealing element 220. In some instances, the degradable metal coating 230 comprises a tensile strength sufficient to physically compress the sealing element 220 so as to keep sealing element 220 from expanding even if fluid leaks in causing the sealing element 220 to begin to expand. In such cases, the degradable metal coating 230 comprises a tensile strength sufficient to contain the sealing element 220 during preliminary swelling due to initial contact with a wellbore fluid. In at least some instances, the coating 230 has a tensile strength from about 5,000 psi to about 35,000 psi. In some cases, the coating 230 has a tensile strength from about 10,000 psi to about 35,000 psi, or from about 15,000 psi to about 35,000 psi, or from about 20,000 psi to about 35,000 psi, or from about 25,000 psi to about 35,000 psi, or from about 30,000 psi to about 35,000 psi, or from about 5,000 psi to about 25,000 psi, or from about 10,000 psi to about 25,000 psi, or from about 15,000 psi to about 25,000 psi.

According to at least one aspect of the present disclosure, the degradable metal coating 230 prevents all swelling of the sealing element 220 and swellable packer assembly 200 for an initial predetermined amount of time. After the initial predetermined period of time, the degradable metal coating 230 degrades and swelling of the sealing element 220 accelerates. In at least some instances, the degradable metal coating 230 substantially prevents fluid transfer to the sealing element 220 for a predetermined period of time. Following the predetermined period of time, an increasing amount of fluid transfer to the sealing element 220 occurs as the degradable metal coating 230 degrades. In another aspect of the present disclosure, the degradable metal coating 230 protects the swellable packer assembly 200 including sealing element 220 while the swellable packer assembly 200 is run downhole and for a predetermined about of time after the swellable packer assembly 200 is installed in the wellbore or wellbore tubular. In at least some instances, the degradable metal coating 230 provide a hermetic seal with respect to sealing element 220 until the degradable metal coating 230 substantially degrades. In some cases, the degradable metal coating 230 provides a barrier between at least a portion of the sealing element 220 and wellbore fluids such that there is substantially no contact between the sealing element 220, or an outer surface 221 thereof, and a wellbore fluid until the degradable metal coating 230 has degraded.

According to at least one aspect of the present disclosure, the degradable metal coating 230 can be selectively removed after a predetermined period of time by exposure to wellbore fluids or by exposure to a triggering fluid that may be pumped downhole. Thus, the degradable metal coating 230 may be selectively removed after a predetermined period of time by passively allowing the ambient wellbore fluids to interact with the degradable metal coating 230 causing it to degrade. Alternatively, the degradable metal coating 230 may be selectively removed after a predetermined amount of time by actively changing the downhole fluid to which the degradable metal coating 230 is exposed. For example, in some instances, an oil-based mud may be replaced with a brine in order to trigger degradation of the degradable metal coating 230. In other cases, injecting or pumping a low pH fluid downhole may be used to trigger the degradation of the degradable metal coating 230 or increase the degradation rate of the degradable metal coating 230. Alternatively, a triggering fluid comprising citric acid may be injected or pumped downhole in order to accelerate or initiate degradation of the degradable metal coating 230. In such cases, the degradable metal coating 230 may be characterized as providing for an indefinite delay in degradation while exposure to the citric acid triggering fluid may cause the degradable metal coating 230 to produce a one hour delay in degradation sufficient to cause the sealing element to expand as a result of exposure to wellbore fluids. In some cases, the triggering fluid is circulated downhole from the surface. In other cases, the triggering fluid is released downhole.

Figure 4:
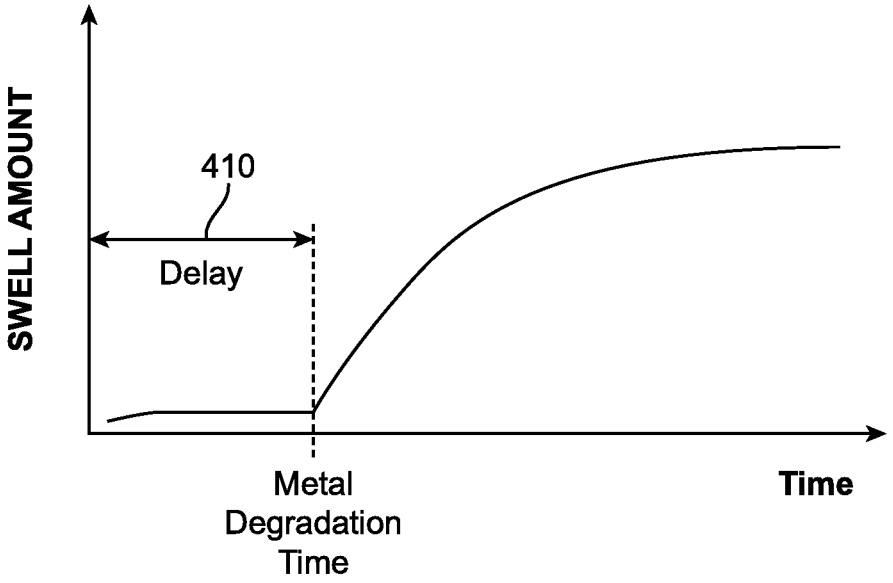
FIG. 4 is a plot depicting the amount of swelling over time for a degradable metal coating that may be employed in a swellable packer assembly, according to an exemplary embodiment of the present disclosure.

FIG. 4 depicts a plot illustrating the amount of swelling over time for a degradable metal coating that may be employed in a swellable packer assembly, according to an exemplary embodiment of the present disclosure. As depicted in FIG. 4, the degradable metal coating 230 may be characterized by a delay period 410, corresponding to a predetermined period of time, before the degradable metal coating 230 degrades sufficient to cause the sealing element 220 to be exposed to wellbore fluid and swell resulting in expansion of the swellable packer assembly 200 to engage the wall of a wellbore or tubular. The characteristic delay period 410, e.g., the predetermined period of time, may be determined by selecting the composition of the degradable metal coating or by triggering the degradation of degradable metal coating by exposing the degradable metal coating to a triggering fluid.

According to at least one aspect of the present disclosure, coating 230 does not require a retaining element. In at least some instances, the degradable metal coating 230 can be crimped, swedged, or coated with wax, glue, or other sealant to minimize water ingress along the edges. The presently disclosed coatings 230 are especially well suited to elevated temperatures and higher salinity fluids.

Referring to FIG. 2, the mandrel 210 may at least in some instances define a continuous axial flowbore 211 that allows fluid movement through the mandrel 210. In at least some instances, the mandrel 210 may comprise a cylindrical or tubular structure or body. The mandrel 210 may be coaxially aligned with the central axis 205 of the swellable packer assembly 200. In some instances, the mandrel 210 may comprise an unitary structure (e.g., a single unit of manufacture, such as a continuous length of pipe or tubing). Alternatively, the mandrel 210 may comprise two or more operably connected components (e.g., two or more coupled sub-components, such as by a threaded connection). In other cases, mandrel 210 may comprise any suitable structure appreciated by those of skill in the art. The tubular body of the mandrel 210 generally defines a continuous axial flowbore 211 that allows fluid movement through the mandrel 210.

In some instances, the mandrel 210 may be configured for incorporation into the wellbore tubular 120. In other cases, the mandrel 210 may be configured for incorporation into any suitable tubular string, such as for example, a wok string, a tool string, a segmented tubing string, a jointed pipe string, a coiled tubing string, a production tubing string, a drill string, the like, or combinations thereof. In such cases, the mandrel 210 may comprise a suitable connection to the wellbore tubular 120 (e.g., to a casing string member, such as a casing joint). Suitable connections to a casing string will be known to those of skill in the art. In such an embodiment, the mandrel 210 is incorporated within the wellbore tubular 120 such that the axial flowbore 211 of the mandrel 210 is in fluid communication with the axial flowbore 121 of the wellbore tubular 120.

According to at least one aspect of the present disclosure, the swellable packer assembly 200 may include one or more optional retaining elements 240. The optional retaining element 240 may be disposed circumferentially about the mandrel 210 adjacent to and abutting the sealing element 220 on each side of the sealing element 220, as depicted in FIG. 2. Alternatively, the optional retaining element 240 may be adjacent to and abutting the sealing element 220 on one side only, such as for example on a lower side of the sealing element 220, or on an upper side of the sealing element 220. The optional retaining element 240 may be secured onto the mandrel by any suitable retaining mechanism, such as for example screws, pins, shear pins, retaining bands, and the like, or combinations thereof.

The optional retaining element 240 may prevent or limit the longitudinal movement (e.g., along the central axis 205) of the sealing element 220 about the mandrel 210, while the sealing element 220 disposed circumferentially about the mandrel 210 is placed within the wellbore and/or subterranean formation. In some instances, the optional retaining element 240 may prevent or limit the longitudinal expansion (e.g., along the central axis 205) of the sealing element 220, while allowing the radial expansion of the sealing element 220.

In at least some cases, the swellable packer assembly 200 may further comprise a coating protectant disposed on the degradable metal coating 230 in order to protect the degradable metal coating 230 from corrosion during storage and transport and/or to reduce exposure to moisture. The coating protectant may be, for example, a lubricant, silicone grease, or a polymer protectant.

The degradable metal coating 230 may be an alloy of magnesium, aluminum, or calcium. In some instances, the degradable metal coating 230 may be a metal alloy comprising magnesium, aluminum, calcium, and any combination thereof.

According to at least one aspect of the present disclosure, the degradable metal coating 230 may comprise a doped magnesium alloy. The doped magnesium alloy may be one of a doped MG magnesium alloy, a doped WE magnesium alloy, a doped AZ magnesium alloy, a doped AM magnesium alloy, or a doped ZK magnesium alloy. As defined herein, a "doped MG magnesium alloy" is an alloy comprising at least magnesium, dopant, and optional supplemental material, as defined herein; a "doped WE magnesium alloy" is an alloy comprising at least a rare earth metal, magnesium, dopant, and optional supplemental material, as defined herein; a "doped AZ magnesium alloy" is an alloy comprising at least aluminum, zinc, magnesium, dopant, and optional supplemental material, as defined herein; a "doped AM magnesium" is an alloy comprising at least aluminum, manganese, magnesium, dopant, and optional supplemental material, as defined herein; and a "ZK magnesium alloy" is an alloy comprising at least zinc, zirconium, magnesium, dopant, and optional supplemental material, as defined herein. Accordingly, any or all of the doped MG magnesium alloy, the doped WE magnesium alloy, the doped AZ magnesium alloy, the doped AM magnesium alloy, or the doped ZK magnesium alloy may comprise a supplemental material, or may have no supplemental material, without departing from the scope of the present disclosure.

The doped magnesium alloys described herein exhibit a greater degradation rate compared to non-doped magnesium alloys owing to their specific composition, the presence of the dopant, the presence of inter-granular inclusions, or both. For example, the zinc concentration of a ZK magnesium alloy may vary from grain to grain within the alloy, which produces an inter-granular variation in the galvanic potential. As another example, the dopant in a doped AZ magnesium alloy may lead to the formation of inter-granular inclusions where the inter-granular inclusions have a slightly different galvanic potential than the grains in the alloy.

The doped magnesium alloys described herein may further comprise an amount of material, termed "supplementary material," that is defined as neither the primary chemical elements of the magnesium alloy or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped magnesium alloy. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material, discussed in greater detail below, may enter the doped magnesium alloys of the present invention due to natural carry-over from raw materials, oxidation of magnesium or other elements, manufacturing processes (e.g., smelting processes, casting processes, alloying process, and the like), or the like. Alternatively, the supplementary material may be intentionally included additives placed in the doped magnesium alloy to impart a beneficial quality to the alloy, as discussed below. Generally, the supplemental material is present in the doped magnesium alloys described herein in an amount of less than about 10% by weight of the doped magnesium alloy, including no supplemental material at all (i.e., 0%).

Magnesium concentrations in each of the doped magnesium alloys described herein may vary depending on the desired properties of the alloy. Moreover, the type of doped magnesium alloy (e.g., MG, WE, AZ, ZK, and AM) influence the desired amount of magnesium. Moreover, the amount of magnesium, as well as other metals, dopants, and/or other materials may affect the tensile strength, yield strength, elongation, thermal properties, fabrication characteristics, corrosion properties, and the like.

The doped MG magnesium alloys of the present disclosure comprise magnesium in an amount in the range of from about 85% to about 99.95% by weight of the doped MG magnesium alloy, encompassing any value and subset therebetween. Additionally, the doped MG magnesium alloy comprises a dopant in the amount in the range of from about 0.05% to about 15% by weight of the doped MG magnesium alloy. Finally, the doped MG magnesium alloys of the present disclosure may comprise supplementary material, as defined above and discussed below, in an amount in the range of from about 0% to about 10% by weight of the doped MG magnesium alloy, encompassing any value and subset therebetween. That is, in some instances, the doped MG magnesium alloy comprises no supplemental material.

A specific example of a doped MG magnesium alloy for use in forming at least one component of a downhole tool according to the embodiments described herein comprises 85% to 99.95% of magnesium by weight of the doped MG magnesium alloy, 0.05% to 15% dopant by weight of the doped MG magnesium alloy, and 0% to 10% of supplemental material by weight of the doped MG magnesium alloy. In another example, the doped MG magnesium alloy comprises 85% to 99.95% of magnesium by weight of the doped MG magnesium alloy, 0.05% to 5% dopant by weight of the doped MG magnesium alloy, and 0% to 10% of supplemental material by weight of the doped MG magnesium alloy. In preferred embodiments, the dopant is iron, nickel, copper, and any combination thereof. Dopants are discussed in greater detail below.

The doped WE magnesium alloys of the present disclosure may comprise magnesium in an amount in the range of from about 40% to about 98.95% by weight of the doped WE magnesium alloy, encompassing any value and subset therebetween. The doped WE magnesium alloy may further comprise a rare earth metal in an amount in the range of from about 1% to about 15% by weight of the doped WE magnesium alloy, encompassing any value and subset therebetween. The rare earth metal may be selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof. In preferred embodiments, the rare earth metal comprises yttrium. Additionally, the doped WE magnesium alloy may comprise a dopant in the amount in the range of from about 0.05% to about 15% by weight of the doped WE magnesium alloy. Finally, the doped WE magnesium alloys of the present disclosure may comprise supplementary material, as defined above and discussed below, in an amount in the range of from about 0% to about 10% by weight of the doped WE magnesium alloy, encompassing any value and subset therebetween. That is, in some instances, the doped WE magnesium alloy comprises no supplemental material.

A specific example of a doped WE magnesium alloy for use forming at least one component of a downhole tool according to the embodiments described herein comprises 40% to 98.95% of magnesium by weight of the doped WE magnesium alloy, 1% to 15% of a rare earth metal by weight of the doped WE magnesium alloy, 0.05% to 15% dopant by weight of the doped WE magnesium alloy, and 0% to 10% of supplemental material by weight of the doped WE magnesium alloy. As another specific example, the doped WE magnesium alloy of the present disclosure comprises 40% to 98.95% of magnesium by weight of the doped WE magnesium alloy, 1% to 15% of a rare earth metal by weight of the doped WE magnesium alloy, 0.5% to 5% dopant by weight of the doped WE magnesium alloy, and 0% to 10% of supplemental material by weight of the doped WE magnesium alloy.

As yet another specific example of a doped WE magnesium alloy for use in forming at least one component of a downhole tool according to the embodiments described herein comprises 88% to 95% of magnesium by weight of the doped WE magnesium alloy, 3% to 5% of yttrium by weight of the doped WE magnesium alloy, 2% to 5% of a rare earth metal that is not yttrium by weight of the doped WE magnesium alloy, and 0.05% to 5% of dopant by weight of the doped WE magnesium alloy. As another specific example, the doped WE magnesium alloy for use in forming at least one component of a downhole tool according to the embodiments described herein comprises 86.6% to 90.6% magnesium by weight of the doped WE magnesium alloy, about 4% yttrium by weight of the doped WE magnesium alloy, about 4% of a rare earth metal that is not yttrium by weight of the doped WE magnesium alloy, 1% to 5% of dopant selected from the group consisting of iron, nickel, copper, and any combination thereof by weight of the doped WE magnesium alloy, and about 0.4% supplemental material of zirconium by weight of the doped WE magnesium alloy.

The doped AZ magnesium alloys of the present disclosure may comprise magnesium in an amount in the range of from about 57.3% to 98.85% of magnesium by weight of the doped AZ magnesium alloy, encompassing any value and subset therebetween. The doped AZ magnesium alloy may further comprise aluminum in an amount in the range of from about 1% to about 12.7% by weight of the doped AZ magnesium alloy, encompassing any value and subset therebetween. The doped AZ magnesium alloy may further comprise zinc in an amount in the range of from about 0.1% to about 5% by weight of the doped AZ magnesium alloy, encompassing any value and subset therebetween. Additionally, the doped AZ magnesium alloy may comprise a dopant in the amount in the range of from about 0.05% to about 15% by weight of the doped WE magnesium alloy. Finally, the doped AZ magnesium alloys of the present disclosure may comprise supplementary material, as defined above and discussed below, in an amount in the range of from about 0% to about 10% by weight of the doped AZ magnesium alloy, encompassing any value and subset therebetween. That is, in some instances, the doped AZ magnesium alloy comprises no supplemental material.

A specific example of a doped AZ magnesium alloy for use forming at least one component of a downhole tool according to the embodiments described herein comprises 57.3% to 98.85% of magnesium by weight of the doped AZ magnesium alloy, 1% to 12.7% aluminum by weight of the doped AZ magnesium alloy, 0.1% to 5% of zinc by weight of the doped AZ magnesium alloy, 0.05% to 15% dopant by weight of the doped AZ magnesium alloy, and 0% to 10% of supplemental material by weight of the doped AZ magnesium alloy. As another specific example, the doped AZ magnesium alloy of the present disclosure comprises 57.3% to 98.85% of magnesium by weight of the doped AZ magnesium alloy, 1% to 12.7% aluminum by weight of the doped AZ magnesium alloy, 0.1% to 5% of zinc by weight of the doped AZ magnesium alloy, 0.5% to 5% dopant by weight of the doped AZ magnesium alloy, and 0% to 10% of supplemental material by weight of the doped AZ magnesium alloy.

In other embodiments, the doped AZ magnesium alloy comprises 57.3% to 98.85% of magnesium by weight of the doped AZ magnesium alloy, 3% to 10% aluminum by weight of the doped AZ magnesium alloy, 0.1% to 5% of zinc by weight of the doped AZ magnesium alloy, 0.05% to 15% dopant by weight of the doped AZ magnesium alloy, and 0% to 10% of supplemental material by weight of the doped AZ magnesium alloy. In some embodiments, the doped AZ magnesium alloy comprises 57.3% to 98.85% of magnesium by weight of the doped AZ magnesium alloy, 3% to 10% aluminum by weight of the doped AZ magnesium alloy, 0.1% to 5% of zinc by weight of the doped AZ magnesium alloy, 0.5% to 5% dopant by weight of the doped AZ magnesium alloy, and 0% to 10% of supplemental material by weight of the doped AZ magnesium alloy.

Other specific examples of the doped AZ magnesium alloy for use as a component of the downhole tools described herein comprise 57.3% to 98.85% of magnesium by weight of the doped AZ magnesium alloy, 1% to 12.7% aluminum by weight of the doped AZ magnesium alloy, 0.1% to 3% of zinc by weight of the doped AZ magnesium alloy, 0.05% to 15% dopant by weight of the doped AZ magnesium alloy, and 0% to 10% of supplemental material by weight of the doped AZ magnesium alloy. The doped AZ magnesium alloy, in some instances, comprises 57.3% to 98.85% of magnesium by weight of the doped AZ magnesium alloy, 1% to 12.7% aluminum by weight of the doped AZ magnesium alloy, 0.1% to 3% of zinc by weight of the doped AZ magnesium alloy, 0.5% to 5% dopant by weight of the doped AZ magnesium alloy, and 0% to 10% of supplemental material by weight of the doped AZ magnesium alloy.

Another specific example of the doped AZ magnesium alloy comprises 57.3% to 98.85% of magnesium by weight of the doped AZ magnesium alloy, 3% to 10% aluminum by weight of the doped AZ magnesium alloy, 0.1% to 3% of zinc by weight of the doped AZ magnesium alloy, 0.05% to 15% dopant by weight of the doped AZ magnesium alloy, and 0% to 10% of supplemental material by weight of the doped AZ magnesium alloy. Additionally, the doped AZ magnesium alloy in some embodiments comprises 57.3% to 98.85% of magnesium by weight of the doped AZ magnesium alloy, 3% to 10% aluminum by weight of the doped AZ magnesium alloy, 0.1% to 3% of zinc by weight of the doped AZ magnesium alloy, 0.5% to 5% dopant by weight of the doped AZ magnesium alloy, and 0% to 10% of supplemental material by weight of the doped AZ magnesium alloy. In other embodiments, the doped AZ magnesium alloy comprises 87% to 97% of magnesium by weight of the doped AZ magnesium alloy, 3% to 10% of aluminum by weight of the doped AZ magnesium alloy, 0.3% to 3% of zinc by weight of the doped AZ magnesium alloy, and 0.05% to 5% of dopant by weight of the doped AZ magnesium alloy.

In another embodiment, the doped AZ magnesium alloy comprises about 88.5% magnesium by weight of the doped AZ magnesium alloy, about 9% aluminum by weight of the doped AZ magnesium alloy, about 0.7% zinc by weight of the doped AZ magnesium alloy, about 1% to about 5% dopant selected from the group consisting of iron, nickel, copper, and any combination thereof by weight of the doped AZ magnesium alloy, about 0.2% supplemental material of manganese by weight of the doped AZ magnesium alloy, and about 0.3% supplemental material of silicon by weight of the doped AZ magnesium alloy. In yet another embodiment, the doped AZ magnesium alloy comprises about 94.5% magnesium by weight of the doped AZ magnesium alloy, about 3% aluminum by weight of the doped AZ magnesium alloy, about 1% zinc by weight of the doped AZ magnesium alloy, about 1% to about 5% dopant selected from the group consisting of iron, nickel, copper, and any combination thereof by weight of the doped AZ magnesium alloy, and about 0.3% supplemental material of manganese by weight of the doped AZ magnesium alloy.

The doped ZK magnesium alloys of the present disclosure may comprise magnesium in an amount in the range of from about 58% to about 98.95% by weight of the doped ZK magnesium alloy, encompassing any value and subset therebetween. The doped ZK magnesium alloy may further comprise zinc in an amount in the range of from about 1% to about 12% by weight of the doped ZK magnesium alloy, encompassing any value and subset therebetween. The doped ZK magnesium alloy may further comprise zirconium in an amount in the range of from about 0.01% to about 5% by weight of the doped ZK magnesium alloy, encompassing any value and subset therebetween. Additionally, the doped ZK magnesium alloy may comprise a dopant in the amount in the range of from about 0.05% to about 15% by weight of the doped ZK magnesium alloy. Finally, the doped ZK magnesium alloys of the present disclosure may comprise supplementary material, as defined above and discussed below, in an amount in the range of from about 0% to about 10% by weight of the doped ZK magnesium alloy, encompassing any value and subset therebetween. That is, in some instances, the doped ZK magnesium alloy comprises no supplemental material.

A specific example of a doped ZK magnesium alloy for use forming at least one component of a downhole tool according to the embodiments described herein comprises 58% to 98.95% of magnesium by weight of the doped ZK magnesium alloy, 1% to 12% of zinc by weight of the doped ZK magnesium alloy, 0.01% to 5% of zirconium by weight of the doped ZK magnesium alloy, 0.05% to 15% dopant by weight of the doped ZK magnesium alloy, and 0% to 10% of supplemental material by weight of the doped ZK magnesium alloy. As another specific example, the doped WE magnesium alloys of the present disclosure comprises 58% to 98.95% of magnesium by weight of the doped ZK magnesium alloy, 1% to 12% of zinc by weight of the doped ZK magnesium alloy, 0.01% to 5% of zirconium by weight of the doped ZK magnesium alloy, 0.5% to 5% dopant by weight of the doped ZK magnesium alloy, and 0% to 10% of supplemental material by weight of the doped ZK magnesium alloy.

In other embodiments, the doped ZK magnesium alloy comprises 58% to 98.95% of magnesium by weight of the doped ZK magnesium alloy, 3% to 8% of zinc by weight of the doped ZK magnesium alloy, 0.01% to 5% of zirconium by weight of the doped ZK magnesium alloy, 0.05% to 15% dopant by weight of the doped ZK magnesium alloy, and 0% to 10% of supplemental material by weight of the doped ZK magnesium alloy. In some embodiments, the doped ZK magnesium alloy comprises 58% to 98.95% of magnesium by weight of the doped ZK magnesium alloy, 3% to 8% of zinc by weight of the doped ZK magnesium alloy, 0.01% to 5% of zirconium by weight of the doped ZK magnesium alloy, 0.5% to 5% dopant by weight of the doped ZK magnesium alloy, and 0% to 10% of supplemental material by weight of the doped ZK magnesium alloy. The doped ZK magnesium alloy, in other embodiments, comprises 88% to 96% of magnesium by weight of the doped ZK magnesium alloy, 2% to 7% of zinc by weight of the doped ZK magnesium alloy, 0.45% to 3% of zirconium by weight of the doped ZK magnesium alloy, and 0.05% to 5% of dopant by weight of the doped ZK magnesium alloy.

In another embodiment, the doped ZK magnesium alloy comprises about 91.9% magnesium by weight of the doped ZK magnesium alloy, about 5.9% zinc by weight of the doped ZK magnesium alloy, about 0.2% zirconium by weight of the doped ZK magnesium alloy, and about 2% dopant selected from the group consisting of copper, nickel, iron, and any combination thereof by weight of the doped ZK magnesium alloy. In another specific, the doped ZK magnesium alloy for use in the embodiments of the present disclosure comprises 89.9% magnesium by weight of the doped ZK magnesium alloy, 3.2% zinc by weight of the doped ZK magnesium alloy, 0.6% zirconium by weight of the doped ZK magnesium alloy, and 6.3% dopant selected from the group consisting of copper, nickel, iron, and any combination thereof by weight of the doped ZK magnesium alloy.

The doped AM magnesium alloys of the present disclosure may comprise magnesium in an amount in the range of from about 61% to about 97.85% by weight of the doped AM magnesium alloy, encompassing any value and subset therebetween. The doped AM magnesium alloy may further comprise aluminum in an amount in the range of from about 2% to about 10% by weight of the doped AM magnesium alloy, encompassing any value and subset therebetween. The doped AM magnesium alloy may further comprise manganese in an amount in the range of from about 0.1% to about 4% by weight of the doped AM magnesium alloy, encompassing any value and subset therebetween. Additionally, the doped AM magnesium alloy may comprise a dopant in the amount in the range of from about 0.05% to about 15% by weight of the doped AM magnesium alloy. Finally, the doped AM magnesium alloys of the present disclosure may comprise supplementary material, as defined above and discussed below, in an amount in the range of from about 0% to about 10% by weight of the doped AM magnesium alloy, encompassing any value and subset therebetween. That is, in some instances, the doped AM magnesium alloy comprises no supplemental material.

In some embodiments, the doped AM magnesium alloy comprises 61% to 97.85% of magnesium by weight of the doped AM magnesium alloy, 2% to 10% of aluminum by weight of the doped magnesium alloy, 0.1% to 4% of manganese by weight of the doped AM magnesium alloy, 0.05% to 15% of dopant by weight of the doped AM magnesium alloy, and 0% to 10% of supplemental material by weight of the doped AM magnesium alloy. In some embodiments, a specific example of a doped AM magnesium alloy for use in the embodiments of the present disclosure comprises 61% to 97.85% of magnesium by weight of the doped AM magnesium alloy, 2% to 10% of aluminum by weight of the doped magnesium alloy, 0.1% to 4% of manganese by weight of the doped AM magnesium alloy, 0.05% to 5% of dopant by weight of the doped AM magnesium alloy, and 0% to 10% of supplemental material by weight of the doped AM magnesium alloy. In other embodiments, the doped AM magnesium alloy comprises 87% to 97.85% of magnesium by weight of the doped AM magnesium alloy, 2% to 10% of aluminum by weight of the doped magnesium alloy, 0.1% to 4% of manganese by weight of the doped AM magnesium alloy, 0.5% to 5% of dopant by weight of the doped AM magnesium alloy, and 0% to 10% of supplemental material by weight of the doped AM magnesium alloy.

In another specific embodiment, the doped AM magnesium alloy for used in the embodiments of the present disclosure comprises about 91.4% magnesium by weight of the doped AM magnesium alloy, about 6% of aluminum by weight of the doped AM magnesium alloy, about 0.2% manganese by weight of the doped AM magnesium alloy, about 2% dopant selected from the group consisting of copper, nickel, iron, and any combination thereof by weight of the doped AM magnesium alloy, about 0.2% supplemental material of silicon by weight of the doped AM magnesium alloy, and about 0.2% supplemental material of zinc by weight of the doped AM magnesium alloy.

The various supplemental materials that may be included in the doped magnesium alloys described herein, may be natural reaction products or raw material carryover. Examples of such natural supplemental materials may include, but are not limited to, oxides (e.g., magnesium oxide), nitrides (e.g., magnesium nitride), sodium, potassium, hydrogen, and the like, and any combination thereof. In other embodiments, the supplemental materials may be intentionally included in the doped magnesium alloys described herein to impart a desired quality. For example, in some embodiments, the intentionally included supplemental materials may include, but are not limited to, a reinforcing agent, a corrosion retarder, a corrosion accelerant, a reinforcing agent (i.e., to increase strength or stiffness, including, but not limited to, a fiber, a particulate, a fiber weave, and the like, and combinations thereof), silicon, calcium, lithium, manganese, tin, lead, thorium, zirconium, beryllium, cerium, praseodymium, yttrium, and the like, and any combination thereof. Although some of these supplementary materials overlap with the primary elements of a particular doped magnesium alloy, they are not considered supplementary materials unless they are not a primary element of the doped magnesium alloy in which they are included. These intentionally placed supplemental materials may, among other things, provide enhance the mechanical properties of the doped magnesium alloy into which they are included.

Each value for the primary elements of the doped magnesium alloys, dopant, and supplemental material described above is critical for use in the embodiments of the present disclosure and may depend on a number of factors including, but not limited to, the type of downhole tool and component(s) formed from the doped magnesium alloy, the type and amount of dopant selected, the inclusion and type of supplemental material, the amount of supplemental material, the desired degradation rate, the conditions of the subterranean formation in which the downhole tool is used, and the like.

In some embodiments, the rate of degradation of the doped magnesium alloys described herein may be in the range of from about 1% to about 100% of its total mass per about 24 hours in a 3% electrolyte solution (e.g., potassium chloride in an aqueous fluid) at about 93° C. (200° F.). In other embodiments, the dissolution rate of the doped magnesium alloy may be in the range of from about 1 milligram per square centimeter ($mg/cm^2$) to about 2000 $mg/cm^2$ per about one hour in a 15% electrolyte solution (e.g., a halide salt, such as potassium chloride or sodium chloride, in an aqueous fluid) at about 93° C. (200° F.), encompassing any value and subset therebetween.

According to at least one aspect of the present disclosure, the degradable metal coating 230 may comprise a doped aluminum alloy. The aluminum in the doped aluminum alloy is present at a concentration in the range of from about 50% to about 99% by weight of the doped aluminum alloy, encompassing any value and subset therebetween. For example, suitable aluminum alloys may have aluminum concentrations of about 45% to about 50%, or about 50% to about 60%, about 60% to about 70%, or about 70% to about 80%, or about 80% to about 90%, or about 90% to about 99% by weight of the doped aluminum alloy, encompassing any value and subset therebetween. Each of these values is critical to the embodiments of the present disclosure and may depend on a number of factors including, but not limited to, the type of aluminum alloy, the desired degradability of the aluminum alloy, and the like.

Suitable dopants for use in forming the doped aluminum alloys described herein may include, but are not limited to, copper, nickel, mercury, tin, chromium, cobalt, calcium, carbon, lithium, manganese, magnesium, calcium, sulfur, silicon, silver, gold, palladium, gallium, indium, tin, zinc, and any combination thereof. In some embodiments, preferred dopants include copper, iron, nickel, tin, cobalt, chromium, silver, gold, silicon, calcium, and carbon and any combination thereof. The dopant may be included with the doped aluminum alloys described herein in an amount of from about 0.05% to about 25% by weight of the doped aluminum alloy, encompassing every value and subset therebetween. For example, the dopant may be present in an amount of from about 0.05% to about 3%, or about 3% to about 6%, or about 6% to about 9%, or about 9% to about 12%, or about 12% to about 15%, or about 15% to about 18%, or about 18% to about 21%, or about 21% to about 25%, or about 0.5% to about 15%, or about 0.5% to about 25%, or about 0.5% to about 10%, by weight of the doped aluminum alloy, encompassing every value and subset therebetween. Other examples include a dopant in an amount of from about 1% to about 10% by weight of the doped aluminum alloy, encompassing every value and subset therebetween. Each of these values is critical to the embodiments of the present disclosure and may depend on a number of factors including, but not limited to, the type of aluminum alloy selected, the desired rate of degradation, the wellbore environment, and the like, and any combination thereof.

In at least some instances, the doped aluminum alloy may comprise about 0.05% to about 25% of the following dopants by weight of the doped aluminum alloy, less than about 0.5% gallium (including 0%) by weight of the doped aluminum alloy, and less than about 0.5% mercury (including 0%) by weight of the doped aluminum alloy, wherein the dopant is selected from the group consisting of iron, copper, nickel, tin, chromium, silver, gold, palladium, carbon, and any combination thereof. In some instances, the aluminum may be at least 64% of the doped aluminum alloy by weight. In some embodiments, the dopant concentrations may also preferably be 0.5% to 15%. In some embodiments, the dopant may preferably be copper, nickel, cobalt, or a combination thereof at about 2% to about 25%.

Examples of specific doped aluminum alloys for use in the present disclosure may include, but are not limited to, a doped silumin aluminum alloy (also referred to simply as "a doped silumin alloy"), a doped Al—Mg aluminum alloy, a doped Al—Mg—Mn aluminum alloy, a doped Al—Cu aluminum alloy, a doped Al—Cu—Mg aluminum alloy, a doped Al—Cu—Mn—Si aluminum alloy, a doped Al—Cu—Mn—Mg aluminum alloy, a doped Al—Cu—Mg—Si—Mn aluminum alloy, a doped Al—Zn aluminum alloy, a doped Al—Cu—Zn aluminum alloy, and any combination thereof. As defined herein, a "doped silumin aluminum alloy" is an alloy comprising at least silicon, aluminum, dopant, and optional supplemental material, as defined herein; a "doped Al—Mg aluminum alloy" is at alloy comprising at least magnesium, aluminum, dopant, and optional supplemental material, as defined herein; a "doped Al—Mg—Mn aluminum alloy" is an alloy comprising at least magnesium, manganese, aluminum, dopant, and optional supplemental material, as defined herein; a "doped Al—Cu aluminum alloy" is an alloy comprising at least copper, aluminum, dopant, and optional supplemental material, as defined herein; a "doped Al—Cu—Mg aluminum alloy" is an alloy comprising at least copper, magnesium, aluminum, dopant, and optional supplemental material, as defined herein; a "doped Al—Cu—Mn—Si aluminum alloy" is an alloy comprising at least copper, manganese, silicon, aluminum, dopant, and optional supplemental material, as defined herein; a "doped Al—Cu—Mn—Mg aluminum alloy" is an alloy comprising at least copper, manganese, magnesium, aluminum, dopant, and optional supplemental material, as defined herein; a "doped Al—Cu—Mg—Si—Mn aluminum alloy" is an alloy comprising at least copper, magnesium, silicon, manganese, aluminum, dopant, and optional supplemental material, as defined herein; a "doped Al—Zn aluminum alloy" is an alloy comprising at least zinc, aluminum, dopant, and optional supplemental material, as defined herein; and a "doped Al—Cu—Zn aluminum alloy" is an alloy comprising at least copper, zinc, aluminum, dopant, and optional supplemental material, as defined herein.

Accordingly, any or all of the doped silumin aluminum alloy, the doped Al—Mg aluminum alloy, the doped Al—Mg—Mn aluminum alloy, the doped Al—Cu aluminum alloy, the doped Al—Cu—Mg aluminum alloy, the doped Al—Cu—Mn—Si aluminum alloy, the doped Al—Cu—

Mn—Mg aluminum alloy, the doped Al—Cu—Mg—Si—Mn aluminum alloy, the doped Al—Zn aluminum alloy, and/or the doped Al—Cu—Zn aluminum alloy, may comprise a supplemental material, or may have no supplemental material, without departing from the scope of the present disclosure. The specific doped aluminum alloys are discussed in greater detail below.

The doped aluminum alloys described herein may further comprise an amount of material, termed "supplementary material," that is defined as neither the primary alloy, other specific alloying materials forming the doped aluminum alloy, or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped aluminum alloys. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material, as discussed in greater detail below, may enter the doped aluminum alloys of the present disclosure due to natural carry-over from raw materials, oxidation of the alloys or other elements, manufacturing processes (e.g., smelting processes, casting processes, alloying process, and the like), or the like, and any combination thereof. Alternatively, the supplementary material may be intentionally included additives placed in the doped aluminum alloy to impart a beneficial quality to the alloy, as discussed below. Generally, the supplemental material is present in the doped aluminum alloys described herein in an amount of less than about 10% by weight of the doped aluminum alloy, including no supplemental material at all (i.e., 0%).

According to at least one aspect of the present disclosure, the degradable metal coating 230 may comprise a magnesium alloy that comprises from about 3% to 8% by weight aluminum, from about 1% to 4% by weight strontium, and from about 0% to about 2% by weight manganese, and the remainder magnesium alloy.

According to at least one aspect of the present disclosure, the composition of the degradable metal coating 230 may be selected in order to produce a predetermined amount of time for the degradable metal coating 230 to degrade thereby exposing the sealing element 220 to a wellbore fluid. According to at least one aspect of the present disclosure, the predetermined amount of time before the degradable metal coating 230 degrades may be modified by adjusting the doping of the doped magnesium alloy.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

Statements of the Disclosure Include

Statement 1: A swellable packer assembly for positioning in a wellbore, the swellable packer assembly comprising: a mandrel; a sealing element disposed about a least a portion of the mandrel, the sealing element formed of a material responsive to exposure to a fluid in a wellbore to radially expand from the mandrel; and a degradable metal coating disposed about at least a portion of an outer surface of the sealing element, the degradable metal coating fluidly isolating the portion of an outer surface of the sealing element from a fluid external to an exterior surface of the coating; wherein the degradable metal coating is selectively removable from the mandrel downhole so as to expose the sealing element to the fluid in the wellbore.

Statement 2: A swellable packer assembly according to Statement 1, wherein the degradable metal coating is selectively removable from the mandrel upon downhole application of a voltage to the coating.

Statement 3: A swellable packer assembly according to Statement 1 or Statement 2, wherein the degradable metal coating is selectively removable from the mandrel upon exposure to a downhole fluid.

Statement 4: A swellable packer assembly according to any one of the preceding Statements 1-3, wherein the degradable metal coating is configured to degrade upon contact with a downhole fluid so as to expose the sealing element to the fluid in the wellbore.

Statement 5: A swellable packer assembly according to any one of the preceding Statements 1-4, wherein the coating is configured to degrade in a downhole environment of a wellbore after a predetermined amount of time so as to expose the sealing element to the fluid in the wellbore.

Statement 6: A swellable packer assembly according to any one of the preceding Statements 1-5, wherein the degradable metal coating comprises a metal or metal alloy dissolvable upon exposure to a wellbore fluid.

Statement 7: A swellable packer assembly according to any one of the preceding Statements 1-6, wherein the degradable metal coating galvanically corrodes upon exposure to a wellbore fluid.

Statement 8: A swellable packer assembly according to any one of the preceding Statements 1-7, wherein the degradable metal coating is a metal alloy comprising at least one selected from the group consisting of magnesium, aluminum, and calcium.

Statement 9: A swellable packer assembly according to any one of the preceding Statements 1-8, wherein the degradable metal coating exhibits a tensile strength of from about 5,000 psi to about 35,000 psi.

Statement 10: A swellable packer assembly according to any one of the preceding Statements 1-9, wherein the degradable metal coating exhibits a thickness of from about 20 thousandths of an inch to about a quarter inch.

Statement 11: A swellable packer assembly according to any one of the preceding Statements 1-10, wherein the degradable metal coating comprises a doped magnesium alloy selected from the group consisting of: a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy; a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy; a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy; a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy; a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

Statement 12: A swellable packer assembly according to Statement 11, wherein the degradable metal coating comprises from about 0.5% to 5% dopant.

Statement 13: A swellable packer assembly according to Statement 11 or Statement 12, wherein the wherein the rare earth metal in the doped WE magnesium alloy that is not yttrium is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

Statement 14: A swellable packer assembly according to any one of the preceding Statements 1-13, wherein the degradable metal coating does not require a retaining element in order to be disposed at least a portion of an outer surface of the sealing element.

Statement 15: A swellable packer assembly according to any one of the preceding Statements 1-14, wherein the degradable metal coating is formed by one of spray deposition, electronic deposition, shrink wrapping, adhesive tape, and adhesive wrap.

Statement 16: A swellable packer assembly according to any one of the preceding Statements 1-15, wherein the degradable metal coating is chemically bonded to at least a portion of the outer surface of the sealing element.

Statement 17: A swellable packer assembly according to any one of the preceding Statements 1-16, wherein the degradable metal coating is disposed about at a least a portion of the outer surface of the sealing element as a result of an adhesive.

Statement 18: A method of using a swellable packer assembly, the method comprising: running a swellable packer assembly into a wellbore on a conveyance so as to position the swellable packer assembly at a predetermined downhole location, wherein the sealing element of the swellable packer assembly is in an inactivated configuration; selectively removing a degradable metal coating disposed about at least a portion of an outer surface of the sealing element; and causing the sealing element to be exposed to a wellbore fluid thereby activating the sealing element to induce swelling of the sealing element.

Statement 19: A method according to Statement 18, wherein selectively removing a degradable metal coating comprises causing the degradable metal coating to be exposed to a wellbore fluid.

Statement 20: A method according to Statement 19, wherein selectively removing a degradable metal coating comprises exposing the degradable metal coating to a trigger fluid circulated from the surface or released by a downhole tool.

Statement 21: A method according to Statement 20, wherein selectively removing a degradable metal coating comprises applying a voltage to the degradable metal coating.

Statement 22: A method according to any one of the preceding Statements 18-21, further comprising selectively removing the degradable metal coating after a predetermined period of time.

Statement 23: A downhole swellable packer system comprising: a conveyance; a mandrel coupled with the conveyance; a sealing element disposed about a least a portion of the mandrel, the sealing element formed of a material responsive to exposure to a trigger fluid in a wellbore to radially expand from the mandrel; and a degradable metal coating disposed about at least a portion of an outer surface of the sealing element, the degradable metal coating fluidly isolating the portion of an outer surface of the sealing element from an exterior of the coating; wherein the degradable metal coating is selectively removable from the mandrel downhole so as to expose the sealing element to the trigger fluid in the wellbore.

Statement 24: A system according to Statement 23, further comprising a triggering fluid disposed within the wellbore, the triggering fluid configured to cause the degradable metal coating to degrade.

Statement 25: A system according to Statement 23 or Statement 24, wherein the degradable metal coating is a metal alloy comprising at least one selected from the group consisting of magnesium, aluminum, and calcium.

Statement 26: A system according to Statement 23 or Statement 24, wherein the degradable metal coating comprises a doped magnesium alloy comprising from about 0.5% to 5% dopant.

Statement 27: A system according to Statement 23 or Statement 24, wherein the degradable metal coating comprises a doped magnesium alloy selected from the group consisting of: a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy; a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy; a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy; a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy; a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

Statement 28: A method of making a swellable packer assembly, the method comprising: providing a sealing element disposed about a least a portion of a mandrel, wherein the sealing element comprises a material responsive to exposure to a fluid in a wellbore to radially expand from the mandrel; and depositing a degradable metal coating on at least a portion of an outer surface of a sealing element.

Statement 29: A method according to Statement 28, wherein the degradable metal coating is a metal alloy comprising at least one selected from the group consisting of magnesium, aluminum, and calcium.

Statement 30: A method according to Statement 28 or Statement 29, wherein the degradable metal coating exhibits a tensile strength of from about 5,000 psi to about 35,000 psi.

Statement 31: A method according to any one of Statements 28-30, wherein the degradable metal coating exhibits a thickness of from about 20 thousandths of an inch to about a quarter inch.

Statement 32: A method according to any one of the preceding Statements 28-31, wherein the degradable metal coating comprises a doped magnesium alloy comprising from about 0.5% to 5% dopant.

Statement 33: A method according to any one of the preceding Statements 28-31, wherein the degradable metal coating comprises a doped magnesium alloy selected from the group consisting of: a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy; a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy; a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy; a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy; a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

Statement 34: The method according to Statement 33, wherein the rare earth metal in the doped WE magnesium alloy that is not yttrium is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

Statement 35: The method according to any one of the preceding Statements 28-34, wherein the degradable metal coating does not require a retaining element in order to be disposed at least a portion of an outer surface of the sealing element.

Statement 36: The method according to any one of the preceding Statements 28-35, wherein the degradable metal coating is formed by one of spray deposition, electronic deposition, shrink wrapping, adhesive tape, and adhesive wrap.

Statement 37: The method according to any one of the preceding Statements 28-36, wherein the degradable metal coating is chemically bonded to at least a portion of the outer surface of the sealing element.

Statement 38: The method according to any one of the preceding Statements 28-36, wherein the degradable metal coating is disposed about at a least a portion of the outer surface of the sealing element as a result of an adhesive.

Statement 39: The system according to any one of the preceding Statements 23-27, wherein the triggering fluid is an organic acid.

Statement 40: The system according to any one of the preceding Statements 23-27, wherein the triggering fluid is selected from the group consisting of citric acid, formic acid, lactic acid, and any combination thereof.

Statement 41: The system according to any one of the preceding Statements 23-25, wherein the degradable metal coating comprises a doped aluminum alloy.

Statement 42: The system according to any one of the preceding Statements 23-25, wherein the degradable metal coating comprises a magnesium alloy that comprises from about 3% to 8% by weight aluminum, from about 1% to 4% by weight strontium, and from about 0% to about 2% by weight manganese, and the remainder magnesium alloy.

Statement 43: The method according to any one of the preceding Statements 28-31, wherein the degradable metal coating comprises a doped aluminum alloy.

Statement 44: The method according to any one of the preceding Statements 28-31, wherein the degradable metal coating comprises a magnesium alloy that comprises from about 3% to 8% by weight aluminum, from about 1% to 4% by weight strontium, and from about 0% to about 2% by weight manganese, and the remainder magnesium alloy.

Statement 45: The method according to Statement 20, wherein the trigger fluid is an organic acid.

Statement 46: The method according to Statement 20, wherein the trigger fluid is selected from the group consisting of citric acid, formic acid, lactic acid, and any combination thereof.

Statement 47: The swellable packer assembly according to any one of the preceding Statements 1-10, wherein the degradable metal coating comprises a doped aluminum alloy.

Statement 48: The swellable packer assembly according to any one of the preceding Statements 1-10, wherein the degradable metal coating comprises a magnesium alloy that comprises from about 3% to 8% by weight aluminum, from about 1% to 4% by weight strontium, and from about 0% to about 2% by weight manganese, and the remainder magnesium alloy.

We claim:

1. A swellable packer assembly for positioning in a wellbore, the swellable packer assembly comprising:

a mandrel;

a sealing element disposed about a least a portion of the mandrel, the sealing element formed of a material responsive to exposure to a fluid in a wellbore to radially expand from the mandrel; and a degradable metal coating disposed about at least a portion of an outer surface of the sealing element, the degradable metal coating fluidly isolating the portion of an outer surface of the sealing element from a fluid external to an exterior surface of the coating, wherein the degradable metal coating comprises a doped magnesium alloy selected from the group consisting of:

a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy;

wherein the degradable metal coating is selectively removable from the mandrel downhole so as to expose the sealing element to the fluid in the wellbore.

2. The swellable packer assembly according to claim 1, wherein the degradable metal coating is a metal alloy comprising at least one selected from the group consisting of magnesium, aluminum, and calcium.

3. The swellable packer assembly according to claim 1, wherein the degradable metal coating comprises a doped magnesium alloy comprising from about 0.5% to 5% dopant.

4. The swellable packer assembly according to claim 1, wherein the wherein the rare earth metal in the doped WE magnesium alloy that is not yttrium is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

5. The swellable packer assembly according to claim 1, wherein the degradable metal coating exhibits a tensile strength of from about 5,000 psi to about 35,000 psi.

6. The swellable packer assembly according to claim 1, wherein the degradable metal coating exhibits a thickness of from about 20 thousandths of an inch to about a quarter inch.

7. The swellable packer assembly according to claim 1, wherein the degradable metal coating does not require a retaining element in order to be disposed at least a portion of an outer surface of the sealing element.

8. The swellable packer assembly according to claim 1, wherein the degradable metal coating is formed by one of spray deposition, electronic deposition, shrink wrapping, adhesive tape, and adhesive wrap.

9. The swellable packer assembly according to claim 1, wherein the degradable metal coating coupled to at least a portion of the outer surface of the sealing element by chemical bonding or by an adhesive.

10. A method of using a swellable packer assembly, the method comprising:

running a swellable packer assembly into a wellbore on a conveyance so as to position the swellable packer assembly at a predetermined downhole location, wherein the sealing element of the swellable packer assembly is in an inactivated configuration;

selectively removing a degradable metal coating disposed about at least a portion of an outer surface of the sealing element, wherein the degradable metal coating comprises a doped magnesium alloy selected from the group consisting of:

a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprising about 94.5% magnesium, about 3% aluminum, about I % zinc, I % to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy; and causing the sealing element to be exposed to a wellbore fluid thereby activating the sealing element to induce swelling of the sealing element.

11. The method according to claim 10, wherein selectively removing a degradable metal coating comprises causing the degradable metal coating to be exposed to a wellbore fluid.

12. The method according to claim 10, wherein selectively removing a degradable metal coating comprises exposing the degradable metal coating to a trigger fluid circulated from the surface or released by a downhole tool.

13. The method according to claim 10, wherein selectively removing a degradable metal coating comprises applying a voltage to the degradable metal coating.

14. The method according to claim 10, further comprising selectively removing the degradable metal coating after a predetermined period of time.

15. A downhole swellable packer system comprising:

a conveyance;

a mandrel coupled with the conveyance;

a sealing element disposed about a least a portion of the mandrel, the sealing element formed of a material responsive to exposure to a trigger fluid in a wellbore to radially expand from the mandrel; and a degradable metal coating disposed about at least a portion of an outer surface of the sealing element, the degradable metal coating fluidly isolating the portion of an outer surface of the sealing element from an exterior of the coating, wherein the degradable metal coating comprises a doped magnesium alloy selected from the group consisting of:

a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprising about 94.5% magnesium, about 3% aluminum, about I % zinc, I % to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy;

wherein the degradable metal coating is selectively removable from the mandrel downhole so as to expose the sealing element to the trigger fluid in the wellbore.

16. The system according to claim 15, further comprising a triggering fluid disposed within the wellbore, the triggering fluid configured to cause the degradable metal coating to degrade.

17. The system according to claim 15, wherein the degradable metal coating is a metal alloy comprising at least one selected from the group consisting of magnesium, aluminum, and calcium.

18. The system according to claim 15, wherein the degradable metal coating comprises a doped magnesium alloy comprising from about 0.5% to 5% dopant.

* * * * *